US009010490B1

(12) United States Patent
Mosier

(10) Patent No.: US 9,010,490 B1
(45) Date of Patent: Apr. 21, 2015

(54) LADDER STABILIZING APPARATUS

(71) Applicant: Ladder Safety Magnet, LLC, El Dorado, AR (US)

(72) Inventor: Tim Mosier, Hope, AR (US)

(73) Assignee: Ladder Safety Magnet, LLC, El Dorado, AR (US)

( * ) Notice: Subject to any disclaimer, the term of this patent is extended or adjusted under 35 U.S.C. 154(b) by 0 days.

(21) Appl. No.: 14/094,964

(22) Filed: Dec. 3, 2013

Related U.S. Application Data

(63) Continuation-in-part of application No. 13/155,703, filed on Jun. 8, 2011, now Pat. No. 8,616,335.

(51) Int. Cl.
*E06C 7/48* (2006.01)
*E06C 7/18* (2006.01)

(52) U.S. Cl.
CPC ..... *E06C 7/18* (2013.01)

(58) Field of Classification Search
CPC ..... E06C 7/48
USPC ..... 248/206.5; 182/107
See application file for complete search history.

(56) References Cited

U.S. PATENT DOCUMENTS

| | | | | | |
|---|---|---|---|---|---|
| 1,932,143 | A * | 10/1933 | Piercy | 362/398 |
| 3,486,580 | A * | 12/1969 | Norton et al. | 182/214 |
| 6,926,241 | B2 * | 8/2005 | Garrett | 248/229.1 |
| 6,957,826 | B1 * | 10/2005 | MacKarvich | 280/491.3 |
| 7,232,099 | B1 * | 6/2007 | Wilcox | 248/228.1 |
| 2004/0217243 | A1 * | 11/2004 | Laivins et al. | 248/230.1 |
| 2011/0198174 | A1 * | 8/2011 | Ollgaard | 188/378 |

* cited by examiner

*Primary Examiner* — Alvin Chin-Shue

(57) ABSTRACT

An apparatus to secure a ladder to a ferromagnetic work surface, such as a metal storage tank, comprises a pair of brackets removably attached near the top of the ladder. The brackets are hinged to magnet mounts, which each hold a permanent magnet that releasably holds the ladder in place against the work surface. The apparatus prevents the ladder from slipping while a worker is climbing the ladder or while working from the ladder.

10 Claims, 2 Drawing Sheets

LADDER STABILIZING APPARATUS

CROSS-REFERENCE TO RELATED APPLICATIONS

This application is a continuation-in-part of U.S. patent application Ser. No. 13/155,703, filed on Jun. 8, 2011, and entitled "Ladder Securing Apparatus." Such application is incorporated by reference in its entirety herein.

STATEMENT REGARDING FEDERALLY SPONSORED RESEARCH OR DEVELOPMENT

Not applicable.

BACKGROUND OF THE INVENTION

The invention is directed to an apparatus for stabilizing a ladder in a desired position, and in particular to such an apparatus that is used to secure a ladder to a ferromagnetic surface, such as a metal storage tank.

Portable ladders, and in particular the leaning-type extension ladders usually constructed of aluminum or fiberglass, are well known in the art. Such ladders are commonly employed for many industrial applications where a worker much reach a relatively high area in order to perform, for example, painting or various maintenance, inspection, or repair operations.

In order to prevent slippage and resulting injury due to a fall, it is a common safety practice to tie or otherwise secure the top of a portable leaning-type ladder to the adjacent surface during its use. Workplace safety regulations promulgated by the United States Department of Labor's Occupational Safety & Health Administration (OSHA) require that these ladders be secured in certain workplace applications. OSHA estimates that of the portable ladder falls that result in injury or death, 61% occur from ladders that were not properly secured at the top. It is not always practical, however, to tie or secure the ladder to an adjacent surface. One common such application encountered is when a worker uses a portable ladder to reach a relatively high point on a large metal storage tank, such as are commonly used to store oil and other industrial liquids. Various points on these storage tanks must be reached for a number of reasons, including inspection, maintenance, and painting. The sides of these tanks are typically smooth, and contain no readily available means by which the top of a ladder may be secured. As a result, workers have no alternative but to use these ladders without securing them in place, which creates a significant safety risk for the worker. The risk to the worker is particularly great since painting and related work on a tank may require the worker to lean sideward from the ladder, increasing the risk that the ladder may slip during use.

It may also be seen that tying or other common means to secure the top of a portable, leaning-type ladder to a surface requires that a worker reach the top of the ladder before the ladder may be secured in place. Thus the worker is at risk until the worker reaches the top of the ladder and is able to complete the operation of securing the ladder in place. The movements necessary for the worker to secure the ladder in place may themselves lead to a slippage of the ladder, thus creating a risk associated with the very act intended to increase the safety of the further use of the ladder.

Another important safety issue with respect to the use of portable ladders is ensuring that the ladder is positioned at the proper angle with respect to the surface upon which the ladder is placed. OSHA Regulation 1926.1053(b)(5)(i) requires that leaning-type ladders be angled when in use such that the horizontal distance from the top support to the foot of the ladder is approximately one-quarter of the working length of the ladder. The working length is the distance along the ladder between the foot and top support. This ideal angle that results, with the ladder making an angle of about 76° with the horizontal support surface, maximizes the inherent stability of the ladder against slippage. When a portable ladder is in use in the field, however, it may be very difficult to determine whether the ladder is in fact properly positioned prior to use. The ease with which these ladders may be placed into position and the difficulty of determining the proper angle may encourage poor safety habits, particularly when the worker using the ladder is engaged in a time-critical maintenance operation.

It may be seen from the above discussion that an apparatus for stabilizing a portable ladder when there is no readily available surface to secure the top of the ladder in place would be highly desirable. A means of stabilizing the top of a portable ladder in place that does not require the worker to first climb the ladder would also be highly desirable. Finally, a simple, effective means of ensuring that the ladder is positioned at the optimum angle with respect to the surface upon which the ladder is placed would also be highly desirable. A device that combines these desired advantages would be of great benefit in improving the safety of using portable ladders in industry, particularly with respect to portable ladders used in locations where a tie-off at the top of the ladder is not practical.

References mentioned in this background section are not admitted to be prior art with respect to the present invention.

BRIEF SUMMARY OF THE INVENTION

The present invention is directed to an apparatus to secure a ladder in place to a ferromagnetic surface, such surfaces including but not limited to metal storage tanks. The invention does not require the worker to climb the ladder before securing the ladder in place, thus avoiding the risk of fall during the process of climbing and securing the ladder. The invention further ensures that the ladder is positioned at the appropriate OSHA-mandated angle to provide for safe use of the ladder without slippage.

In a first aspect, the invention is directed to a ladder stabilizing apparatus, comprising a first bracket plate, a second bracket plate, a spacer fitted between the first bracket plate and second bracket plate, and a flange fitted between the first bracket plate and second bracket plate, wherein a space is formed between the spacer and flange and between the first bracket plate and second bracket plate sized to receive a stringer of a ladder. A magnet mount is pivotably connected to the flange, and a magnet is attached to the magnet mount opposite the flange.

In a second aspect, the invention is directed to a ladder stabilizing apparatus, comprising at least two stringers, a plurality of rungs, and at least two brackets, wherein each of the brackets is attached to one of the at least two stringers and each of the brackets comprises a flange extending outwardly from the at least two stringers. A magnet mount is pivotably connected to the flange of each of the brackets, and a magnet is attached to the magnet mount opposite the flange of each of the brackets.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENT(S)

Figure 1:
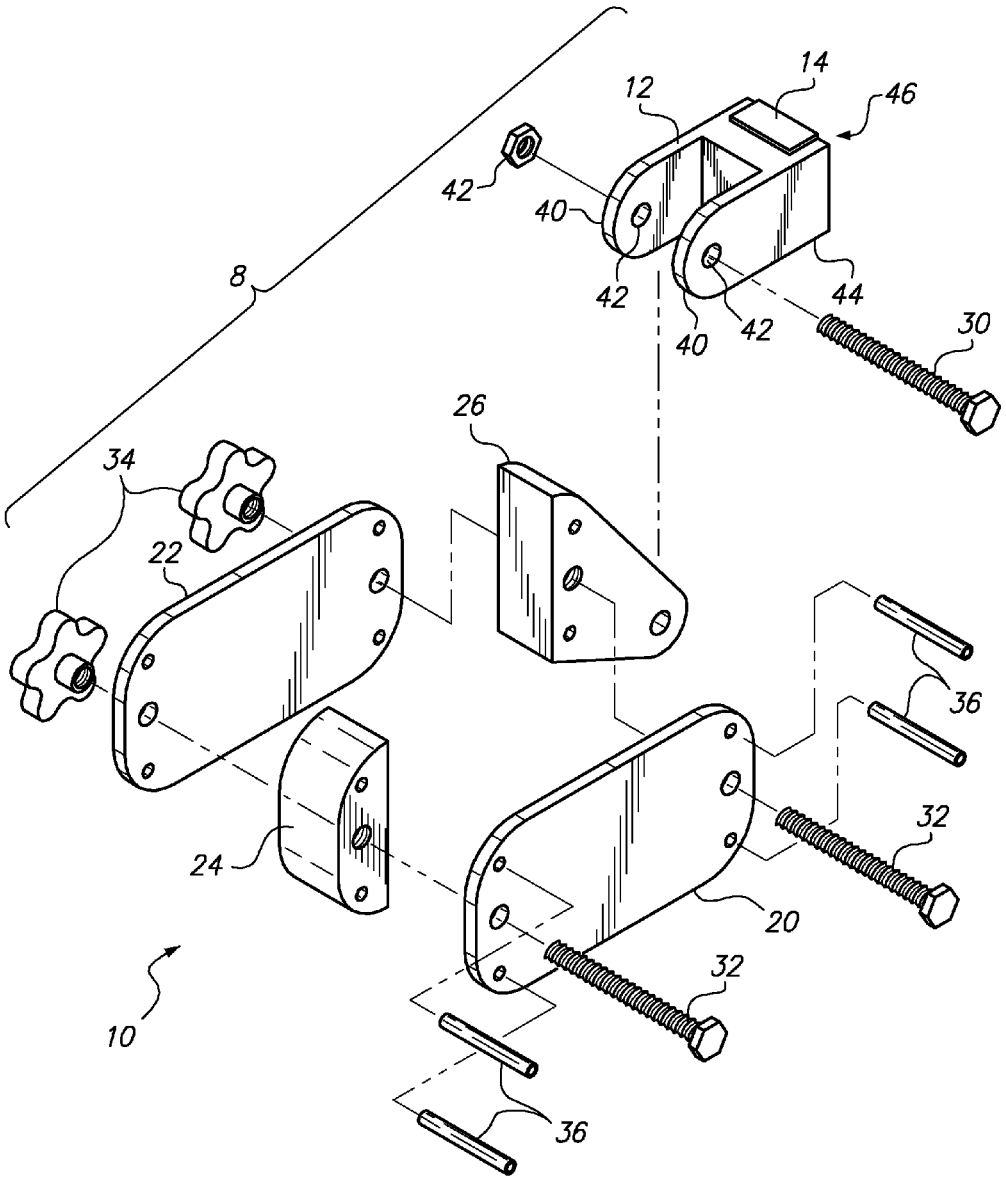
FIG. 1 is an exploded, perspective view of a preferred embodiment of a bracket according to a preferred embodiment of the invention.
Figure 2:
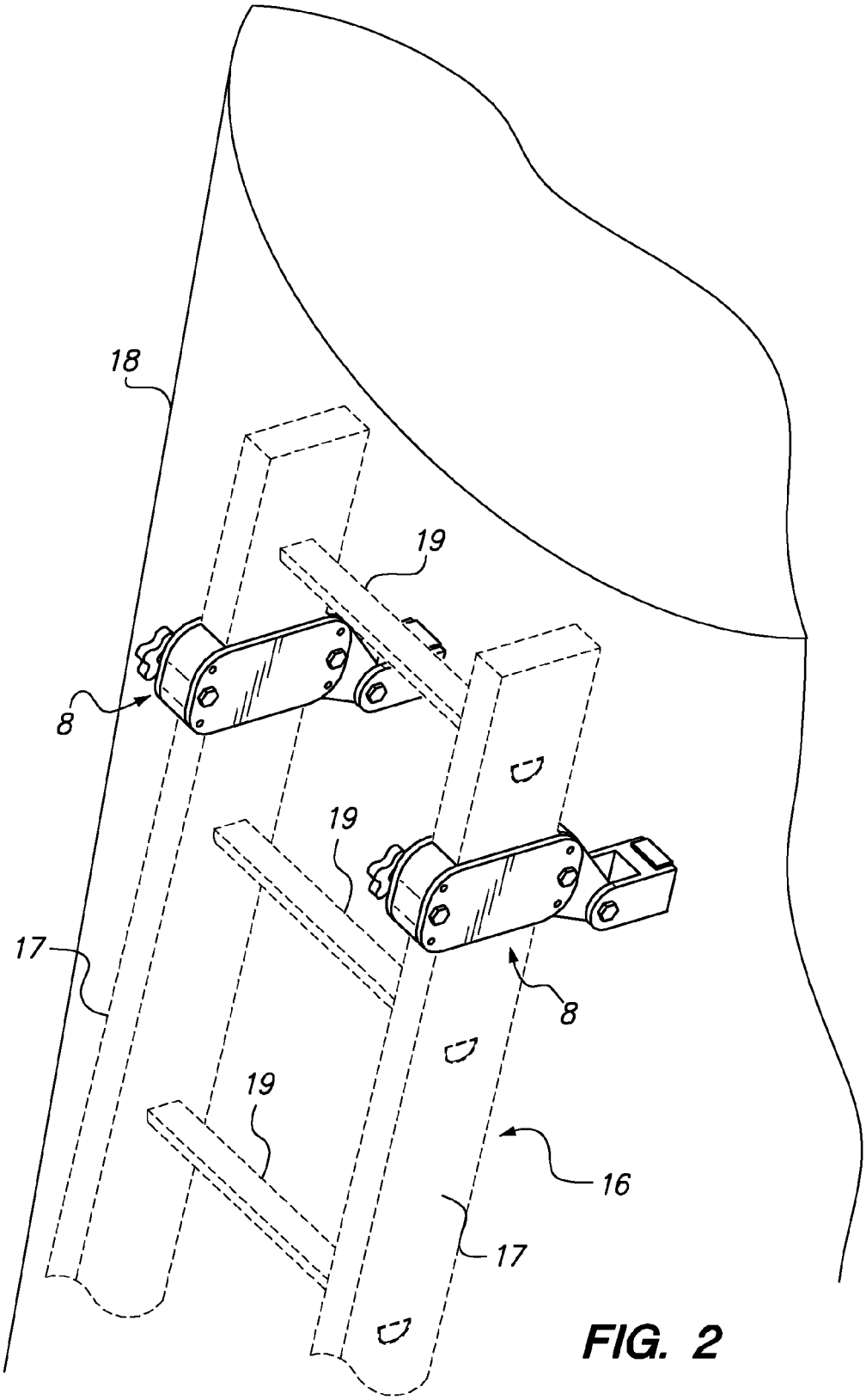
FIG. 2 is a drawing depicting the use of a preferred embodiment of the invention in connection with a leaning-type ladder employed during inspection or maintenance performed at a metal storage tank.

With reference to FIG. 1, an attachment 8 according to a preferred embodiment of the present invention may be described. As illustrated in FIG. 2, two such attachments 8 are used to secure a ladder 16 to a storage tank 18 or other ferromagnetic surface.

Each attachment 8 is formed of a bracket 10, a magnet mount 12, and a magnet 14. Bracket 10 includes two plates that form its longer sides, first bracket plate 20 and second bracket plate 22. These plates are fitted, as shown in FIG. 2, to stringers 17 of ladder 16 such that they are perpendicular to rungs 19 of ladder 16.

Sandwiched between first bracket plate 20 and second bracket plate 22 of each bracket 10 are spacer 24 and flange 26. The thickness of spacer 24 and flange 26 are such that when bracket 10 is tightened on a stringer 17 of ladder 16, stringer 17 is tightly held by friction fit between first bracket plate 20 and second bracket plate 22. In various embodiments, spacer 24 and flange 26 may be formed of a single width of material, or may be formed of multiple pieces stacked together between first bracket plate 20 and second bracket plate 22. In the preferred embodiment, first bracket plate 20, second bracket plate 22, spacer 24, and flange 26 are formed of a sufficiently rigid and durable material to provide a secure connection with a stringer 17 of ladder 16; aluminum is the most preferred material due to its strength and light weight, but steel and other such durable materials may be used in alternative embodiments.

Bracket plate bolts 32 extend through first bracket plate 20, one each passing through spacer 24 and flange 26, and then passing through second bracket plate 22. They are secured by a threaded connection between bracket plate bolts 32 and hand knobs 34. Hand knobs 34 are utilized in the preferred embodiment since they allow bracket 10 to be easily loosened and re-tightened in order to attach or detach bracket 8 to a stringer 17 of ladder 18. Hand knobs 34 are well known in the art, and are preferably formed of a plastic material but may be formed of metals or other materials as well. The term "bolt" as used herein includes all of the various sorts of threaded-rod connectors as are well known in the art, although in the preferred embodiment 3/8" bolts with standard hex heads are used for bracket plate bolts 32.

Pins 36 extend through first bracket plate 20, and then two each passing through spacer 24 and flange 26 (above and below bracket plate bolts 32). Pins 36 are fitted tightly by friction fit in holes sized to receive them in first bracket plate 20, spacer 24, and flange 26. Pins 36 serve to keep first bracket plate 20, spacer 24, and flange 26 together as a unit when second bracket plate 22 is removed from first bracket plate 20 by loosening and removing hand knobs 34 and removing bracket plate bolts 32. In addition, pins 36 serve to prevent spacer 24 and flange 26 from pivoting around bracket plate bolts 32 when attachment 8 is in use.

Bracket plate bolts 32 hold bracket 10 locked onto a stringer 17 of ladder 16 by means of the friction that results by compression of first bracket plate 20 and second bracket plate 22 against stringer 17. By loosening or removing bracket plate bolts 32 and the corresponding hand knobs 34, bracket 10 may be repositioned or removed from stringer 17. It will be seen that it is necessary to remove bracket plate bolts 32 in order to reposition bracket 10 beyond the adjacent rungs 19 of ladder 16.

Magnet mount 12 includes magnet mount wings 40, through which hinge bolt 30 passes, thereby securing magnet mount 12 to bracket 10 in a fashion that allows magnet mount 12 to pivot with respect to bracket 10. Magnet 14 is adhered to magnet mount 12 at the end of flange 26 opposite to first bracket plate 20 and second bracket plate 22. It may be seen that the shape of flange 26 causes magnet mount 12 to extend outwardly from bracket 10, thereby providing an appropriate distance between storage tank 18 and the applicable section of stringer 17 when ladder 16 is in position with respect to storage tank 18. Hinge bolt lock nut 42 attaches to the opposite end of hinge bolt 30 from the head of hinge bolt 30, thereby securely holding magnet mount 12 to bracket 10 while the device is in use while allowing magnet mount 12 to pivot with respect to bracket 8 around hinge bolt 30.

Magnet 14 is preferably a permanent magnet formed of a "hard" ferromagnetic material, such as alnico or hard ferrites. It is aligned on magnet mount 12 such that it provides a magnetic attraction towards a nearby ferromagnetic surface, such as storage tank 18 as shown in FIG. 2. In the preferred embodiment, an alnico permanent magnet with about a 70 lb. effective pull is employed, although various other types of magnets as are known in the art may be substituted in alternative embodiments.

Magnet mount 12 is preferably formed of steel or another sufficiently rigid metal to provide a secure hold for ladder 16 without breaking during use. The various parts of attachment 8 that are permanently connected may be welded together. In alternative embodiments, other materials could be used, such as a resin of sufficient strength. In particular in the case of resin parts, it may be desirable to form multiple parts as described above as an integrated, molded whole.

The structure of a preferred embodiment of attachment 8 having been described, a method of using attachments 8 in order to hold a ladder 16 safely in place may be described with reference to FIG. 2. In this example, a worker desires to reach a high area on the side of a metal storage tank 18, such as for painting or other maintenance reasons. In order to do so, the worker employs ladder 16 to reach the desired height. Two attachments 8 will be employed to hold the top of ladder 16 in place once ladder 16 is leaned against storage tank 18.

In order to connect two attachments 8 to stringers 17 of ladder 16, bracket plate bolts 32 are removed from attachments 8 by first loosening and removing hand knobs 34. This allows the worker to place first bracket plate 20 and second bracket plate 22 of each attachment 8 on opposite sides of the two stringers 17 of ladder 16. It is necessary to remove bracket plate bolts 32 rather than simply loosen them since otherwise bracket 10 could not be slipped onto stringers 17 due to the presence of rungs 19. Complete removal of bracket plate bolts 32 would not be necessary if bracket 10 is positioned at a point on stringers 17 that is above the top rung 19 of ladder 16.

Preferably, both brackets 10 are positioned at points on stringers 17 of ladder 16 that are equidistant from the top of ladder 16, directly across from each other. It may be seen, however, that uneven placement of brackets 10 may be desirable if an uneven work surface were lying underneath ladder 16. Since the brackets 10 are movable to any location on stringers 17, the preferred embodiment allows the worker to compensate for this occurrence and still provide a safely secured position for ladder 16.

In the typical application of climbing a storage tank 18 as depicted in FIG. 2 for inspection, maintenance, painting, or other work functions, the inventor has found that positioning brackets 10 of attachments 8 approximately 14" from the top of the working surface of ladder 16 works well. In the preferred embodiment, the distance from the front face of magnet 14 to the front of stringer 17 (that is, the proximal edge of flange 26) is about 5". With flange 26 of appropriate length to create this 5" distance, and with the appropriate downward angle of flange 26 as shown in FIGS. 1 and 2, the placement of brackets 10 approximately 14" from the top of the working surface of ladder 16 results in approximately the 4:1 ratio as described earlier. This placement ensures that the ladder angle with the horizontal supporting surface is maintained within 5° plus or minus of 76° , most preferably at or about 76° for optimal safety, as set forth in OSHA regulations. In one example, if a ladder is placed at a working length of 20' against a storage tank 18, then the bottom of ladder 16 should be positioned about 5' out. The length and angle of flange 26 is chosen such that, when attachments 8 are set approximately 14" from the top of the working length of ladder 16 and ladder 16 is fitted into position with magnets 14 of attachments 8 against storage tank 18, the ladder is held at or about the correct 4:1 ratio angle in order to meet OSHA requirements. It should be noted that in the case of ladder 16 extending above the top of storage tank 18, then the working length of ladder 16 is the distance from the bottom to the point where the ladder contacts the top of the tank. In such case, the working length is thus less than the full length of ladder 16, since the portion of the ladder extending beyond storage tank 18 is not a part of the working length. The placement of brackets 10 is thus based on the working length of ladder 16 in a particular application, not necessarily the full length of ladder 16.

Once ladder 16 is positioned with the top of ladder 16 resting against storage tank 18 and magnets 14 make contact with storage tank 18, it may be seen that the ladder will be held safely at its top such that the worker may climb the ladder and work from the ladder without the risk of ladder 16 slipping during use. Once the work at a particular location is completed, the worker may climb down ladder 16 and, with a simple twisting motion of ladder 16, disengage first one then another of magnets 14 from storage tank 18. By using the top of ladder 16 against storage tank 18 as a fulcrum and stringers 17 as a lever, the worker is able to apply sufficient leverage to overcome the magnetic attraction of magnets 14 to storage tank 18 and thereby move ladder 16.

In an alternative embodiment of the present invention, bracket 10 is permanently attached to stringers 17 of ladder 16 at the proper position, preferably being approximately 14" from the top of ladder 16. In this case, a single bracket plate may only be required, and this part may be combined with flange 26. Bracket plate bolts 32 may in this case connect stringers 17 directly to bracket 10. This alternative embodiment offers the additional advantage that there is no danger of a worker incorrectly placing bracket 10 at the wrong position on a stringer 17 of ladder 16.

As used herein, "comprising" is synonymous with "including," "containing," or "characterized by," and is inclusive or open-ended and does not exclude additional, unrecited elements or method steps. As used herein, "consisting of" excludes any element, step, or ingredients not specified in the claim element. As used herein, "consisting essentially" of does not exclude materials or steps that do not materially affect the basic and novel characteristics of the claim. When a grouping is used herein, all individual members of the group and all combinations and subcombinations possible of the group are intended to be individually included in the disclosure. When a range is expressed herein, all values within and subsets of that range are intended to be included in the disclosure.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Thus, additional embodiments are within the scope of the invention and within the following claims. In general the terms and phrases used herein have their art-recognized meaning, which can be found by reference to standard texts, journal references and contexts known to those skilled in the art. The preceding definitions are provided to clarify their specific use in the context of the invention.

The present invention has been described with reference to certain preferred and alternative embodiments that are intended to be exemplary only and not limiting to the full scope of the present invention as set forth in the appended claims.

The invention claimed is:

1. A ladder stabilizing apparatus, comprising:

a. a first bracket plate;

b. a second bracket plate;

c. a spacer fitted between the first bracket plate and second bracket plate, wherein the spacer comprises a flat spacer interior face;

d. a flange fitted between the first bracket plate and second bracket plate and extending outwardly from between the first bracket plate and second bracket plate, wherein the flange comprises a flat flange interior face whereby a space is formed between the spacer and flange and between the first bracket plate and second bracket plate sized to receive a stringer of a ladder such that the stringer fits snugly between the flat spacer interior face and the flat flange interior face with the flange extending outwardly in a plane with that of the ladder stringer, and further wherein the spacer and flange each comprise a width equal to a width of the ladder stringer;

e. a magnet mount pivotably connected to the flange; and f. a magnet attached to the magnet mount opposite the flange;

wherein the flange is of such length and angled such that when the ladder stabilizing apparatus is attached to the stringer of the ladder, the ladder maintains about a 4:1 ratio between a working length of the ladder and a horizontal distance from a top support to a foot of the ladder, further comprising:

a. a first bracket plate bolt passing through the first bracket plate, the spacer, and the second bracket plate; and b. a second bracket plate bolt passing through the first bracket plate, the flange, and the second bracket plate.

2. The apparatus of claim 1, wherein the first bracket plate bolt comprises a first bracket plate bolt head and the second bracket plate bolt comprises a second bracket plate bolt head, and further comprising a first hand knob threadably connected to the first bracket plate bolt opposite the first bracket plate bolt head, and a second hand knob threadably connected to the second bracket plate bolt opposite the second bracket plate bolt head.

3. The apparatus of claim 2, further comprising:

a. at least one spacer pin passing through and connecting the first bracket plate and the spacer; and b. at least one flange pin passing through and connecting the first bracket plate and the flange.

4. The apparatus of claim 2, comprising:

a. two spacer pins passing through and connecting the first bracket plate and the spacer on opposite sides of the first bracket plate bolt; and b. two flange pins passing through and connecting the first bracket plate and the flange on opposite sides of the second bracket plate bolt.

5. The apparatus of claim 1, wherein the magnet mount comprises at least one magnet mount wing.

6. The apparatus of claim 5, further comprising a hinge bolt passing through and pivotably connecting the flange and the at least one magnet mount wing.

7. The apparatus of claim 6, wherein the hinge bolt comprises a hinge bolt head and wherein the apparatus further comprises a lock nut threadably connected to the hinge bolt opposite the hinge bolt head.

8. The apparatus of claim 6, wherein the magnet comprises a hard ferromagnetic material.

9. The apparatus of claim 8, wherein the magnet comprises alnico.

10. The apparatus of claim 1, wherein a distance from a proximal edge of the flange to a front face of the magnet is about five inches.

* * * * *